United States Patent [19]

Cosco et al.

[11] 4,001,624

[45] Jan. 4, 1977

[54] SOFT GLASS FLASHTUBE

[75] Inventors: Robert J. Cosco, Amesbury; Roger T. Hebert, Peabody; Paul E. Gates, Danvers, all of Mass.

[73] Assignee: GTE Sylvania Incorporated, Salem, Mass.

[22] Filed: June 6, 1975

[21] Appl. No.: 584,425

[52] U.S. Cl. ..... 313/185; 313/198; 313/220; 313/221; 313/226; 313/201

[51] Int. Cl.[2] ..... H01J 65/00

[58] Field of Search ..... 313/198, 201, 220, 221, 313/224, 185

[56] References Cited

UNITED STATES PATENTS 3,766,421 10/1973 Bonazoli et al. ..... 313/226 X

*Primary Examiner*—Palmer C. Demeo
*Assistant Examiner*—Darwin R. Hostetter
*Attorney, Agent, or Firm*—Edward J. Coleman

[57] ABSTRACT

A xenon flashtube having an envelope formed of soft glass tubing with a pair of electrodes disposed at each end of the envelope for providing a wall-stabilized discharge. The use of soft glass permits a match seal to dumet lead-in wires and results in a lower cost unit.

16 Claims, 1 Drawing Figure

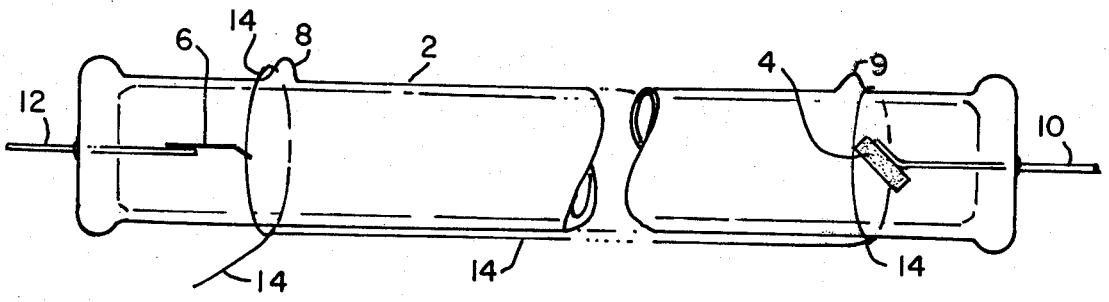
14
6
8
2
4
9
12
10
14
14
14

SOFT GLASS FLASHTUBE

BACKGROUND OF THE INVENTION

This invention relates generally to electric discharge lamps and, more particularly, to flashtubes having a wall-stabilized arc discharge.

Flashtubes generally comprise two spaced apart electrodes within a sealed light-transmitting envelope having a rare gas fill, typically xenon, at subatmospheric pressure. Such lamps are connected across a large capacitor charged to a substantial potential, which is, however, insufficient to ionize the gas fill. Upon application of an additional pulse of sufficient voltage, the xenon is ionized and an electric arc is formed between the two electrodes, discharging the large capacitor through the flash tube, which emits a burst of intense light, usually of short duration. In many cases, a pulse voltage is applied between an external trigger wire wrapped around the envelope and the elctrodes; this is referred to as shunt triggering. Such external triggering may also be achieved by providing the exterior of the envelope with a conductive coating which is connected to a lead wire from the trigger pulse source by means of a narrow metal band slipped over the coated envelope. In other applications the lamp may be internally triggered by applying the pulse voltage directly across the electrodes, a technique referred to as injection triggering.

Typically, the envelopes of flashtubes are formed of quartz, borosilicate glass, or so-called ignition glass, all of which are relatively expensive, generally more difficult to draw and form, and pose special consideration with respect to providing strong metal-to-glass seals. This is particularly true of flashtubes having a wall-stabilized discharge, i.e., wherein the length of the arc path between electrodes is large in comparison with the inside diameter of the envelope. (See High Pressure Mercury Vapor Lamps and Their Applications, edited by W. Elenbaas, Philips Technical Ligrary, 1965, pages 3 and 242–243; also Light Sources, W. Elenbaas, published in U.S. by Crane, Russak and Company, Inc. New York, 1972, pages 127, 163 and 196). Soft glass has been mentioned for use as the bulb material of an electrode-stabilized flashtube, however such a lamp type has an inside diameter of the bulb which is large in comparison to the arc-length; for example see U.S. Pat. No. 3,766,421, column 4, lines 62–65, in which a T-12 bulb of lime glass having a diameter of 1.5 inches is used for a flashtube having an electrode spacing of about 0.100 inch and a loading of about 0.05 joules per flash. In the case of wall-stabilized flashtubes having loadings of several joules, however, it appears that only quartz and hard glasses, such as borosilicate and/or aluminosilicate, have been considered for use as the discharge envelope material, apparently in view of the anticipated thermal and acoustical shock effects upon the discharge confining wall.

In years past, the cost factor of hard glass or quartz flash tubes posed no particular concern in view of the relatively expensive power supplies employed. With the advent of integrated solid state circuitry, however, power supply costs have been reduced considerably, in fact, to the point that the flashtube cost is equivalent ot the once expensive circuitry. Consideration of the use of soft glass envelopes to reduce the cost of wall-stabilized flashtubes has been generally discounted with predictions of failure due to the high coefficient of thermal expansion and the suspected inability of soft glasses to withstand flashtube loadings of several joules.

SUMMARY OF THE INVENTION

Accordingly, it is an object of the present invention to provide a low cost flashtube construction.

It is a particular object to provide a lower cost flashtube of the type having a wall-stabilized discharge and an external shunt triggering means.

Quite unexpectedly, we have discovered that envelopes formed of a soft glass tubing may be employed with successful operating results in the construction of wall-stabilized flashtubes which are to be subject to loadings typically encountered in the low cost electronic photoflash equipment currently available. For example, we have successfully employed a common soft glass, namely potash soda lead glass (Corning type 0120), to form the envelopes of flashtubes having an inside (bore) diameter of 3 millimeters, an arc length of 1.5 inches, and an intended maximum loading of 36 joules for flash durations of about 250 microseconds or less. The key we have discovered which permits soft glass flashtubes to withstand such surprisingly high loadings is the criticality of flash duration in such a lamp. More specifically, for a maximum loading of about 10 joules per square centimeter of the interior surface area of the tubular envelope, the flash duration should not be more than about 250 microseconds as measured between the one-third-of-peak points of the light output pulse. In addition, the peak current density should not exceed 3,540 amperes per square centimeter.

The use of soft-glass envelopes for flashtubes in accordance with the invention not only reduces material cost, but it also significantly lowers the cost of manufacture as the soft glass is typically easier to draw than hard glass and permits match seals to inleads of common dumet wire.

BRIEF DESCRIPTION OF THE DRAWING

This invention will be more fully described hereinafter in conjunction with the accompanying drawing, the single FIGURE of which is a greatly enlarged elevational view of a straight, wall-stabilized flashtube having a soft glass envelope, in accordance with the invention, with an external wire wrap to facilitate shunt triggering.

DESCRIPTION OF PREFERRED EMBODIMENT

Referring to the drawing, the flashtube comprises an hermetically sealed, light-transmitting envelope 2 formed of a straight piece of soft glass tubing (e.g. Corning No. 0120 potash soda lead glass) and having a cathode electrode 4 sealed within one end of the envelope and an anode electrode 6 sealed in the other end. The envelope is filled with a rare gas, such as xenon, at subatmospheric pressure (e.g., 100 Torr) and is constricted to define an exhaust tip 8 near one end of the tubing. A node 9 is formed at the other end of the flashtube for trigger wire retaining purposes.

The flashtube electrodes are energized via lead-in wires 10 and 12 which are sealed through respective ends of the glass envelope 2. More specifically, lead-in wire 10 is connected to cathode 4 and lead-in wire 12 is connected to anode 6. Both the soft glass envelope 2 and the lead-in wires 10 and 12 have mean coefficients of thermal expansion in the range of about 87 to 95 $\times 10^{-7}$ per ° C between 0° and 300° C. Accordingly, the lead-in wires may consist entirely of common dumet wire yet provide a strong match seal to the soft glass without the need for special intermediate sealing materials. The shunt (or external) trigger pulse is applied by means of an external trigger wire 14 wrapped about the exterior of the straight envelope 2 so as to properly ionize the arc discharge path between the cathode and anode electrodes during pulsed operation. More specifically, the trigger wire 14 is looped and tied once about the right end portion of the flashtube, where the loop is retained by node 9. Then the wire is run along the tube and looped once and tied about the left end portion of the flashtube, where the second loop is retained by exhaust tip 8.

Heretofore flashtubes of this type employed envelopes of quartz, ignition glass, or a borosilicate glass. Such materials have softening points in the range of 710° to 1580° C and coefficients of thermal expansion which generally fall below $50 \times 10^{-7}$ per ° C between 0° and 300° C. In contrast, soft glasses are characterized by softening points in the range of about 620° to 700° C and the much higher coefficients of thermal expansion mentioned in the preceding paragraph. It appears to have been deemed inconceivable that soft glasses could withstand the loadings developed in flashtubes. We have discovered, however, that soft glass envelopes can withstand given flashtube loadings if the flash duration is selectively controlled. That is, for a given flashtube resistivity, as determined by arc length, bore size and fill pressure and composition, a selected discharge capacitance up to a predetermined maximum will result in a flash duration less than a predetermined maximum. Thus, we have observed the surprising results that for the same loading ($\frac{1}{2} CV^2$), a voltage across the soft glass flashtube of, say, 400 volts will show no envelope problems, whereas a lower voltage across the tube of, say, 300 volts will cause crazing of the envelope. In the latter case, the factor C is increased to maintain the same loading, but this in turn increases the flash duration. We have observed that over the duration of a flash, the arc discharge column initially appears as a fine filament between the electrodes and expands with time toward the walls of the flashtube envelope. If the flash duration is sufficiently long to permit the discharge plasma to contact the glass walls of the envelope, the extreme thermal shock effects can be deleterious to soft glass. However, by controlling the flash duration so that the expanding discharge plasma will not reach the envelope walls, we have found that soft glass can provide a suitable envelope material for a number of flashtube applications. More specifically, we have found that for a maximum loading of about 10 joules per square centimeter of interior surface area of the tubular soft glass envelope, the flash duration should not be more than about 250 microseconds as measured between the one-third-of-peak points of the light output pulse. In addition, we have determined that the peak current density should be no greater than about 3,540 amperes per square centimeter, as higher current densities have also been found to cause crazing of the soft glass envelope.

According to one specific implementation of a flashtube according to the invention, the straight tubular envelope 2 is formed of Corning type 0120 potash soda lead glass tubing, which has a mean coefficient of thermal expansion of about $89 \pm 1.5 \times 10^{-7}$ per ° C between 0° and 300° C and a softening point of about 630° ± 5° C. The envelope has an inside (bore) diameter of 3 mm., an outside diameter of 4.5 mm., and an arc length between the electrodes 4 and 6 of about 1.5 inches. The lamp is filled with xenon at a pressure of 100 torr. The lead-in wires 10 and 12 comprise 0.025 inch diameter dumet wire, which has a radial coefficient of thermal expansion of about $90 \times 10^{-7}$ per ° C between 25° and 400° C, and are secured by a match seal to the glass through each end of the envelope. In this instance the dumet wire was unborated. The cold cathode electrode 4 comprises a sintered disk of 90 percent tantalum and 10 percent barium aluminate having a porosity of about 10–20 percent. The proportion of $Ba_3Al_2O_6$ may vary from about 5 to 20 percent. The disk, which measures about 0.060 inch in diameter by about about 0.030 inch thick, is welded to the inner end of the dumet wire lead 10, which is bent at 45° to tend to center the cathode with respect to the tubular envelope walls. Anode 6 comprises three thirty-secondths inch long strip of tantalum, of cross-section $1.32 \times 0.005$ inch, which is welded to the inner end of dumet lead 12. Gettering is provided by the tantalum content of the electrodes, while the barium aluminate contained in the cathode is employed to reduce the work function thereof.

In operation, the anode voltage across the flashtube is about 400 volts DC, and 4Kv peak trigger pulse (Class I) is applied to the external trigger wire 14 to ignite the lamp. The maximum energy loading is about 36 joules, and at this loading, the maximum flash duration is about 250 microseconds, while the maximum flash rate is one flash every ten seconds. Maximum peak current is 250 amperes. The demonstrated life of this soft glass flash tube at a loading of 24 joules is about 100,000 flashes.

Although the invention has been described with respect to a specific embodiment, it will be appreciated that modifications and changes may be made by those skilled in the art without departing from the true spirit and scope of the invention. For example, it is contemplated that neon, argon and krypton may also be employed as the fill gas. The invention may also be embodied in a helically shaped flashtube. Other soft glasses that may be applicable include Corning type 0010 potash soda lead glass, which has a softening point of about 625° ± 5° C and a mean coefficient of thermal expansion of about $93 \pm 1.5 \times 10^{-7}$ per ° C between 0° and 300° C, and Corning type 0080 soda lime glass, having a softening point of about 695° ± 5° C and a mean coefficient of thermal expansion of about $92 \pm 1.5 \times 10^{-7}$ per ° C between 0° and 300° C. Of course, in view of the generally recognized unsuitability of lime glass for sealing to dumet lead-in wires, due to leaking problems, a lead glass butt seal or the like would be employed at each end of an envelope formed of type 0080 glass tubing to facilitate a statisfactory lead-in wire seal-through.

What we claim is:

1. A wall-stabilized flashtube comprising:

an hermetically sealed, light-transmitting envelope formed of a soft glass tubing;

a rare gas in said envelope; and a pair of electrodes in said envelope between which an arc discharge path is defined during operation of said flashtube, the length of said arc path being at least double the inside diameter of said envelope tubing whereby said discharge is wall-stabilized, the maximum loading of said flashtube being about 10 joules per square centimeter of the interior surface area of said tubular envelope for flash durations of about 250 microseconds or less as measured between the one-third-of-peak points of the light output pulse.

2. A flashtube according to claim 1 wherein said soft glass has a softening point in the range of about 620° to 700° C and a mean coefficient of thermal expansion in the range of about 87 to $95 \times 10^{-7}$ per ° C and 300° C.

3. A flashtube according to claim 1 wherein said electrodes are disposed with one at each end of said envelope.

4. A flashtube according to claim 3 wherein said envelope is straight and said electrodes provide a cold-cathode arc discharge.

5. A flashtube according to claim 3 further including a pair of dumet lead-in wires, each match-sealed through a respective end of said soft glass envelope and connected to the electrode disposed thereat.

6. A flashtube according to claim 1 further including means for providing external triggering thereof.

7. A flashtube according to claim 6 wherein said means for providing external triggering includes a trigger wire wrapped about the exterior of said envelope.

8. A flashtube according to claim 1 wherein the maximum peak current density of said falshtube is about 3,540 amperes per square centimeter.

9. A flashtube according to claim 8 wherein said soft glass has a softening point in the range of about 620° to 700° C and a mean coefficient of thermal expansion in the range of about 87 to $95 \times 10^{-7}$ per ° C between 0° and 300° C.

10. A flashtube according to claim 9 further including means for providing external triggering thereof.

11. A flashtube according to claim 10 wherein said means for providing external triggering includes a trigger wire wrapped about the exterior of said envelope.

12. A flashtube according to claim 11 wherein said rare gas is xenon.

13. A flashtube according to claim 1 wherein the inside diameter of said soft glass tubing is about 3 millimeters, and the maximum loading of said flashtube is about 24 joules per inch for flash durations of about 250 microseconds or less as measured between the one-third of peak points of the light output pulse.

14. A flashtube according to claim 13 wherein the maximum peak current of said flashtube is about 250 amperes.

15. A flashtube according to claim 14 wherein said rare gas is xenon at a pressure of about 100 torr, and the arc length between said electrodes is about 1.5 inches.

16. A flashtube according to claim 15 wherein said soft glass has a softening point in the range of about 620° to 700° C and a mean coefficient of thermal expansion in the range of about 87 to $95 \times 10^{-7}$ per ° C between 0° and 300° C.

* * * * *